US008979224B2

(12) United States Patent
Jang et al.

(10) Patent No.: US 8,979,224 B2
(45) Date of Patent: Mar. 17, 2015

(54) REFRIGERATOR

(75) Inventors: Suk Ho Jang, Gwangju (KR); Jae Hoon Lim, Suwon-si (KR); Se Hyeon Baek, Goseong-gun (KR); Hong Joo Moon, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 177 days.

(21) Appl. No.: 13/490,977

(22) Filed: Jun. 7, 2012

(65) Prior Publication Data

US 2012/0313497 A1 Dec. 13, 2012

(30) Foreign Application Priority Data

Jun. 8, 2011 (KR) ..... 10-2011-0055220

(51) Int. Cl.

| | |
|---|---|
| ***A47B 96/04*** | (2006.01) |
| ***F25D 23/06*** | (2006.01) |
| *F25D 21/04* | (2006.01) |
| *F25D 23/08* | (2006.01) |

(52) U.S. Cl.

CPC ..... *F25D 23/069* (2013.01); *F25D 21/04* (2013.01); *F25D 23/087* (2013.01)

USPC ..... 312/407

(58) Field of Classification Search

CPC ..... F25D 21/04; F25D 21/08; F25D 21/12; F25D 23/068; F25D 23/069; F25D 23/085; F25D 2400/02; F25D 2400/04

USPC ..... 312/406, 407, 405, 401, 296, 265.5, 312/265.6; 62/441, 272, 275, 277; 220/592.02, 592.06, 592.07, 592.08

See application file for complete search history.

(56) References Cited

U.S. PATENT DOCUMENTS

| | | | | | |
|---|---|---|---|---|---|
| 1,705,455 | A * | 3/1929 | Griffiths | 49/492.1 |
| 4,307,588 | A * | 12/1981 | Smith et al. | 68/23.7 |
| 4,548,049 | A * | 10/1985 | Rajgopal | 62/275 |
| 4,550,576 | A * | 11/1985 | Tate et al. | 62/441 |
| 4,644,698 | A * | 2/1987 | Gerdes et al. | 49/478.1 |
| 4,765,696 | A * | 8/1988 | Cordill et al. | 312/407 |
| 4,821,399 | A * | 4/1989 | Markley et al. | 29/458 |
| 4,955,676 | A * | 9/1990 | Weaver et al. | 312/407 |
| 5,349,832 | A * | 9/1994 | Johnson et al. | 62/447 |
| 5,584,549 | A * | 12/1996 | Lybarger et al. | 312/265 |
| 6,036,294 | A * | 3/2000 | Banicevic et al. | 312/407 |
| 8,366,221 | B2 * | 2/2013 | Kim et al. | 312/405 |
| 2005/0116591 | A1 * | 6/2005 | Hwang et al. | 312/265.6 |

* cited by examiner

*Primary Examiner* — James O Hansen

(74) *Attorney, Agent, or Firm* — Staas & Halsey LLP

(57) ABSTRACT

A refrigerator having a mid-front plate structure that provides a superior coupling strength with respect to a middle wall while ensuring a simple shape and a high strength. The refrigerator includes a coupling member which is fixed to a front surface of the middle wall such that the mid-front plate is fixed to the middle wall. The mid-front plate includes an interior space to accommodate the coupling member and an insertion hole part allowing the coupling member to be inserted into the interior space therethrough. The mid-front plate is fixed to the middle wall by moving the mid-front plate toward the middle wall such that the coupling member fixed to the middle wall is inserted into the interior space and then by pushing the mid-front plate to one side.

7 Claims, 11 Drawing Sheets

REFRIGERATOR

CROSS-REFERENCE TO RELATED APPLICATIONS

This application claims the priority benefit of Korean Patent Application No. 2011-0055220, filed on Jun. 8, 2011 in the Korean Intellectual Property Office, the disclosure of which is incorporated herein by reference.

BACKGROUND

1. Field

Embodiments relate to a mid-front plate installed on a middle wall of a refrigerator.

2. Description of the Related Art

A refrigerator is an apparatus configured to keep food fresh by use of a cooling cycle. The refrigerator has a storage compartment in the body of a refrigerator to store food. The storage compartment may be divided into an upper storage compartment and a lower storage compartment by a middle wall.

The middle wall includes an inner case into which thermal insulating material is formed to insulate heat transferring between the upper storage compartment and the lower storage compartment. A mid-front plate is installed at a front surface of the middle wall. A hot pipe is laid between the mid-front plate and the middle wall to prevent dews from being formed on the mid-front plate by cool air of the storage chamber.

In general, a mid-front plate is installed by inserting a locking protrusion formed on the mid-front plate into an inner case and a reinforcing plate, which is disposed in the inner case, and then pushing the locking protrusion to one side.

SUMMARY

According to an aspect of one or more embodiments, there is provided a mid-front plate of an improved structure having a simple shape, a superior processability and a high strength.

According to an aspect of one or more embodiments, there is provided a coupling structure of a mid-front plate and a middle wall that ensures a sufficient coupling force between the mid-front plate and the middle wall, and prevents leakage of foam liquid filled in an inner case without having to dispose a reinforcing plate in the inner case.

According to an aspect of one or more embodiments, there is provided a refrigerator includes a body, a middle wall, a door, a mid-front plate and a coupling member. The body includes an inner case forming a storage compartment and an outer case enabling thermal insulating material to be formed in a space between the inner case and the outer case. The middle wall is configured to divide the storage compartment into an upper storage compartment and a lower storage compartment. The door is installed on the body to open/close a front surface of the storage compartment that is openable. The mid-front plate is installed on a front surface of the middle wall. The coupling member is configured to fix the mid-front plate to the middle wall while being fixed to the front surface of the middle wall. The mid-front plate includes an interior space to accommodate the coupling member and an insertion hole part enabling the coupling member to be inserted into the interior space therethrough. The mid-front plate is fixed to the middle wall by moving the mid-front plate toward the middle wall such that the coupling member fixed to the middle wall is inserted into the interior space of the mid-front plate and then by pushing the mid-front plate to one side.

A gasket is provided at a rear surface of the door to prevent cool air from leaking, and the gasket automatically comes into close contact with the front surface of the mid-front plate when the storage compartment is closed.

The mid-front plate is formed by bending a single metal plate.

The mid-front plate is provided in a form of a flat tub having one side open.

The mid-front plate further includes a movement hole part which extends from the insertion hole part lengthwise along the mid-front plate, and a locking part which is formed around the movement hole part and is inserted between the middle wall and the coupling member.

The refrigerator further includes a hot pipe configured to prevent frost from being formed on the mid-front plate, wherein the hot pipe is accommodated in the interior space of the mid-front plate.

The hot pipe comes into close contact with and is fixed to a rear surface of the mid-front plate while being pressed by the coupling member.

The refrigerator further includes a buffer member inserted into the interior space to arrange the hot pipe and to reinforce the mid-front plate.

According to an aspect of one or more embodiments, there is provided a refrigerator includes a body, an upper storage compartment, a lower storage compartment, a mid-front plate and a coupling member. The middle wall is configured to divide an interior of the body into an upper storage compartment and a lower storage compartment. The mid-front plate is installed on a front surface of the middle wall. The coupling member is fixed to the front surface of the middle wall to form a coupling gap enabling the mid-front plate to be inserted between the middle wall and the coupling member therethrough.

The coupling member includes a support part which comes into close contact with the middle wall, and a pressing part which is spaced apart from the middle wall to form the coupling gap between the middle wall and the coupling member.

Each of the support part and the pressing part has a circular cross section.

The coupling member includes an elastic clip such that the coupling member is press-fittedly fixed to the middle wall.

According to an aspect of one or more embodiments, there is provided a refrigerator includes a body, a middle wall, a mid-front plate and a coupling member. The middle wall is configured to divide an interior of the body into a upper storage compartment and a lower storage compartment. The mid-front plate is installed on a front surface of the mid-front surface and has an interior space. The coupling member is accommodated in the interior space and is configured to fix the mid-front plate while pressing the mid-front plate toward the middle wall.

The mid-front plate includes an insertion hole part allowing the coupling member to be inserted into the inner space therethrough, a movement hole part, which extends from the insertion hole part such that the mid-front plate moves lenghthwise along the mid-front plate after the coupling member is inserted into the interior space, and a locking part which is formed around the movement hole part to be pressed by the coupling member.

According to an aspect of one or more embodiments, there is provided a refrigerator includes a body, a middle wall, a door, a mid-front plate, a hot pipe and a coupling member. The body has an inner case forming a storage compartment and an outer case enabling thermal insulating material to be formed in a space between the inner case and the outer case. The middle wall is configured to divide the storage compartment into an upper storage compartment and a lower storage compartment. The door is installed on the body to open and close a front surface of the storage compartment that is openable. The mid-front plate is installed on a front surface of the middle wall. The hot pipe is configured to prevent frost from being formed on the mid-front plate. The coupling member is fixed on the front surface of the middle wall such that the mid-front plate is fixed to the middle wall.

The hot pipe and the coupling member are accommodated in the interior space, and the hot pipe is accommodated while making contact with a rear surface of the mid-front plate in the interior space.

According to the present disclosure, the mid-front plate is provided in a simple shape, and thus the workability is improved in manufacturing the mid-front plate.

The mid-front plate has a shape providing a superior strength, so the mid-front plate is prevented from being deformed when installed or in use.

A conventional reinforcing plate is omitted, and a coupling structure between the mid-front plate and the middle wall is simple, thereby facilitating the installation of the mid-front plate.

While thermal insulating material is formed in the inner case of a middle wall through a foaming process, foam liquid is prevented from leaking. Accordingly, the mid-front plate is prevented from being deformed due to expansion of the thermal insulating material being blown.

According to an aspect of one or more embodiments, a refrigerator includes a body; a middle wall configured to divide an interior of the body into a upper storage compartment and a lower storage compartment, and having an inner case; a mid-front plate installed on a front surface of the mid-front surface and having an insertion hole part, a movement hole part, and a locking part, wherein the movement hole part extends from the insertion hole part lengthwise along the mid-front plate; and a coupling member which is configured to fix the mid-front plate toward the middle wall, wherein the coupling member has a connecting hole through which a screw is coupled to the inner case, a support part supported by the middle wall while coming into close contact with the middle wall, and a pressing part having a step difference with respect to the support part.

BRIEF DESCRIPTION OF THE DRAWINGS

These and/or other aspects of embodiments will become apparent and more readily appreciated from the following description, taken in conjunction with the accompanying drawings of which.

DETAILED DESCRIPTION

Figure 1:
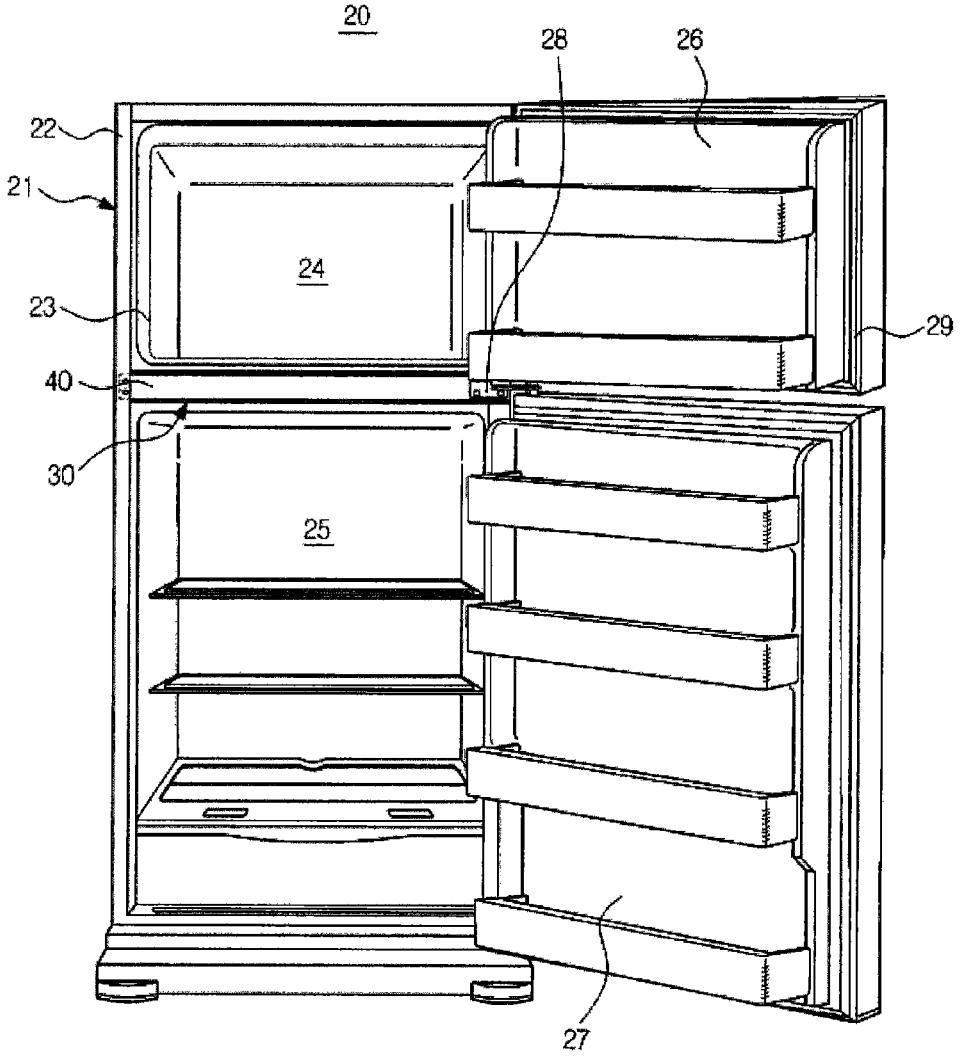
FIG. 1 is a front view illustrating a refrigerator according to an embodiment.

Reference will now be made in detail to embodiments, examples of which are illustrated in the accompanying drawings, wherein like reference numerals refer to like elements throughout.

Figure 10:
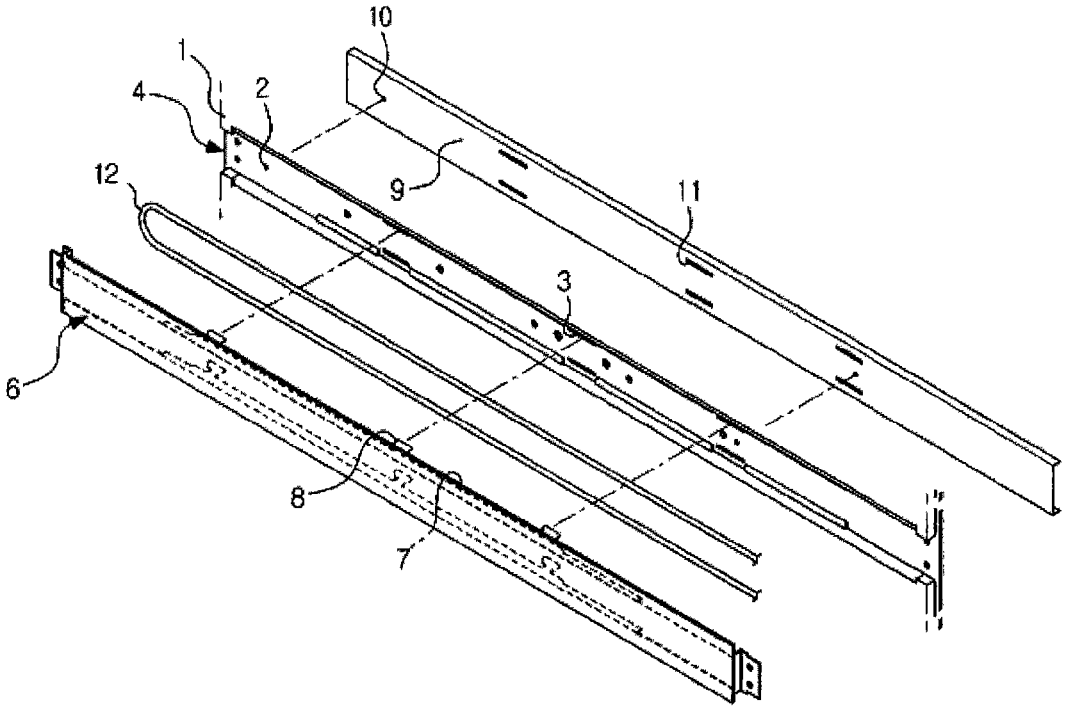
FIG. 10 CONVENTIONAL ART
FIG. 10 is a view illustrating a coupling structure of a mid-front plate and a middle plate according to a conventional embodiment.
Figure 11:
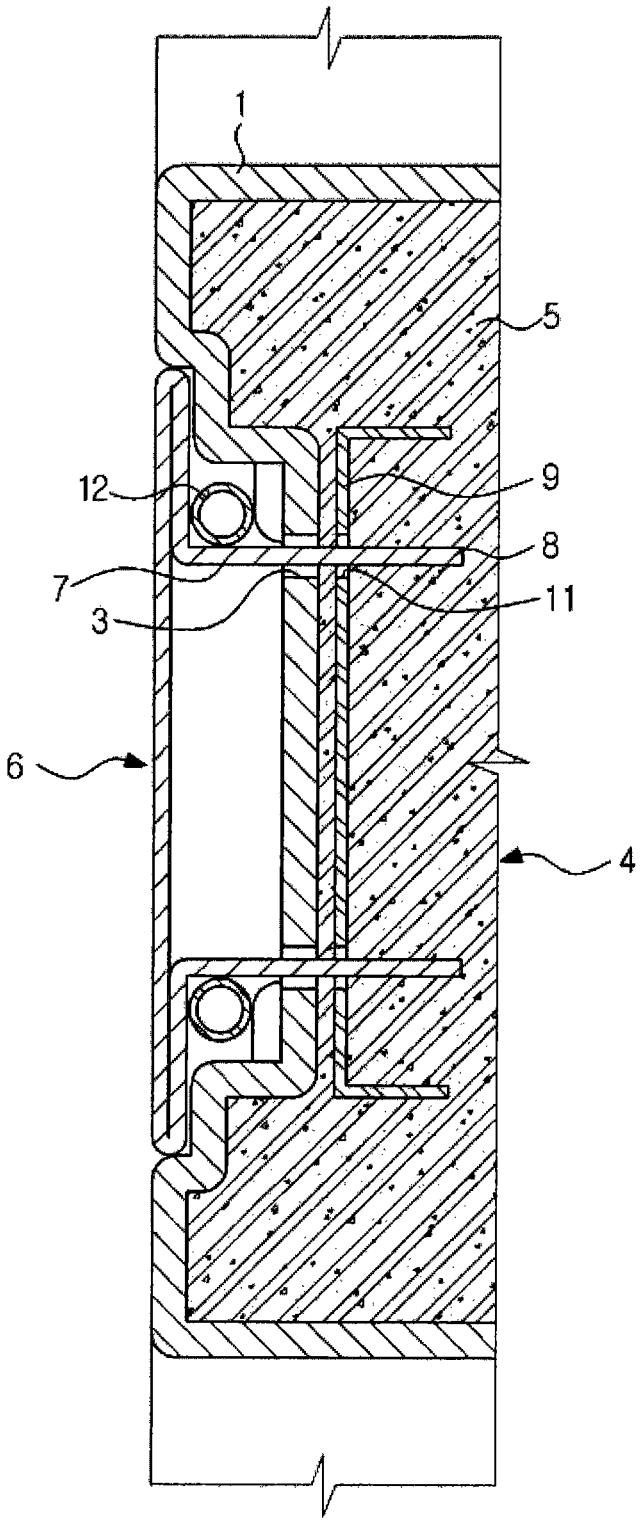
FIG. 11 CONVENTIONAL ART
FIG. 11 is an assembled cross-sectional view of the coupling structure of FIG. 10.

FIG. 10 is a view illustrating the coupling structure of a mid-front plate and a middle plate of a conventional refrigerator. FIG. 11 is an assembled cross-sectional view of the coupling structure of the FIG. 10.

Referring to FIGS. 10 and 11, a middle wall 4 includes an inner case 1 and a thermal insulating material 5 which is formed through expansion inside the inner case 1. The mid-front plate 6 is coupled to the front surface of the middle wall 4.

Each of and upper side and a lower side of the mid-front plate 6 is bent 180 degrees to the inside, and then bent 90 degrees to the middle wall 4, thereby forming an extension part 7. The extension part 7 is provided with a locking protrusion 8 that is coupled to the middle wall 4.

The middle wall 4 has a second fixing hole 3 corresponding to the locking protrusion 8. As the locking protrusion 8 is coupled to the second fixing hole 3, the mid-front plate 6 is fixed to the middle wall 4.

In order to reinforce the front surface of the middle wall 4, a reinforcing plate 9 is coupled to the inside of the inner case 1. The reinforcing plate 9 is provided in the form of a plate that comes into close contact with a portion of the inner case that forms the front surface of the middle wall 4. The reinforcing plate 9 is provided at upper side and at lower side thereof each with a second connecting hole 11. In a state the locking protrusion 8 is inserted to the second connecting hole 11, the reinforcing plate 9 moves to one side to be fixed to the inner case 1.

Meanwhile, a hot pipe 12 is provided in a space between the extension part 7 and the middle wall 4 to prevent dews from being formed on the mid-front plate 6.

The coupling process of the conventional mid-front plate 6 is as follows. First, the reinforcing plate 9 comes into close contact with the inside of the inner case 1. A screw is coupled to a first connecting hole 10 of the reinforcing plate 9 and to a first fixing hole 2 of the inner case 1, so that the reinforcing plate 9 is closely fixed to the inner case 1.

As the locking protrusion 8 of the mid-front plate 6 is pushed to one side while being inserted into the second fixing hole 3 of the inner case 1 and into the second connecting hole 11 of the reinforcing plate 9, the locking protrusion 8 is insertedly coupled to the inner case 1 and to the reinforcing plate 9, and thus the mid-front plate 6 is fixed.

As described above, since the mid-front plate 6 is not strong, the reinforcing plate 9 is additionally coupled to reinforce the strength of the front surface of the middle wall 4. In addition, the thermal insulating material may leak to the outside the inner case 1 through the first and the second fixing holes 2 and 3.

FIG. 1 is a front view illustrating a refrigerator according to an embodiment.

Referring to FIG. 1, the refrigerator 20 comprises a body 21 to store food, storage compartments 24 and 25 provided inside the body 21, a middle wall 30 dividing the storage compartments 24 and 25 into an upper storage compartment 24 and a lower storage compartment 25, and a cooling cycle (not shown) to provide cool air to keep food fresh.

The body 21 comprises an outer case 22 forming an external appearance of the refrigerator 20, an inner case 23 provided inside the outer case 22 to form the storage compartments 24 and 25, and thermal insulating material (not shown) formed between the outer case 22 and the inner case 23 to thermally insulate the storage compartments 24 and 25.

Front surfaces of the upper storage compartment 24 and the lower storage compartment 25 are open to insert and withdraw food. An upper door 26 and a lower door 27 are rotatably installed on one side of the body 21 to open and close the front surfaces of the upper storage compartment 24 and the lower storage compartment 25, respectively.

An upper hinge (not shown) is provided at an upper end of the one side of the body 21 to rotate the upper door 26, and a lower hinge (not shown) is provided at an lower end of the one side of the body 21 to rotate the lower door 27; while a middle hinge 28 is provided on the middle wall 30 to rotate the upper door 26 and the lower door 27.

The middle wall 30 includes the inner case 23 and a thermal insulating material 33 (see FIG. 5) that is formed inside the inner case 23 to prevent heat transfer between the upper storage compartment 24 and the lower storage compartment 25. A mid-front plate 40 is installed at a front surface of the middle wall 30. A gasket 29 provided on the doors 26 and 27 comes into close contact with a front surface of the mid-front plate 30 to seal the storage compartments 24 and 25.

Hereinafter, the configuration and the coupling scheme of the mid-front plate 30 will be described in detail.

Figure 2:
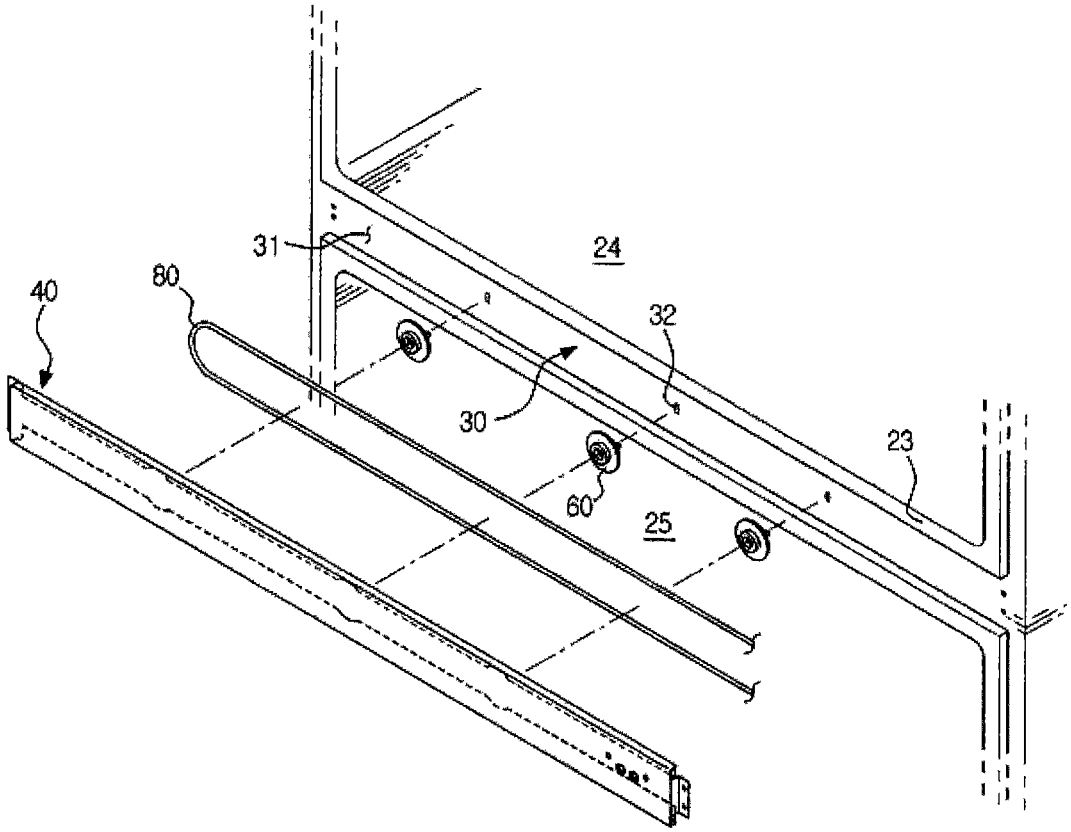
FIG. 2 is a view illustrating a coupling structure of a mid-front plate and a middle wall of the refrigerator according to an embodiment.

FIG. 2 is a view illustrating a coupling structure of a mid-front plate and a middle wall of the refrigerator according to the embodiment of the present disclosure.

Referring to FIG. 2, the mid-front plate 40 is fixedly installed onto the middle wall 30 through at least one coupling member 60.

The coupling member 60 is provided as an integrated body, including polypropylene (PP). The coupling member 60 is fixed to the front surface of the middle wall 30 to enable the mid-front plate 40 to be coupled to the middle wall 30.

The middle wall 30 has a receiving part 31 recessed to a rear side of the middle wall 30 to receive the mid-front plate 40. A fixing hole 32 is formed in the receiving part 31 to fix the coupling member 60 at an inner side of the receiving part 31.

The fixing hole 32 may be provided in a predetermined number, for example at least one, such that at least one fixing hole 32 is spaced apart from each other lengthwise along the mid-front plate 40. An elastic clip 61 (see FIG. 4) of the coupling member 60 is inserted into the fixing hole 32. The elastic clip 61 is press-fittingly inserted into the fixing hole 32, such that the fixing hole 32 is completely sealed by the elastic clip 61, and the thermal insulating material 33 (see FIG. 5) filled in the inner case 23 is prevented from leaking to outside. The elastic clip 61 inserted to the fixing hole 32 will be described later in detail.

A hot pipe 80 is configured to prevent dews from being formed on the mid-front plate 40 due to cool air inside the storage compartments 24 and 25. The hot pipe 80 may be formed by extending a part of a coolant circulation pipe passing a high-temperature coolant that has passed through a compressor (not shown) constituting a cooling cycle (not shown).

The high-temperature coolant passing through the hot pipe 80 can prevent dews from being formed on the mid-front plate 40 due to heat transfer between the coolant and the mid-front plate 40 which is cooled by cool air inside the storage compartments 24 and 25.

Figure 3:
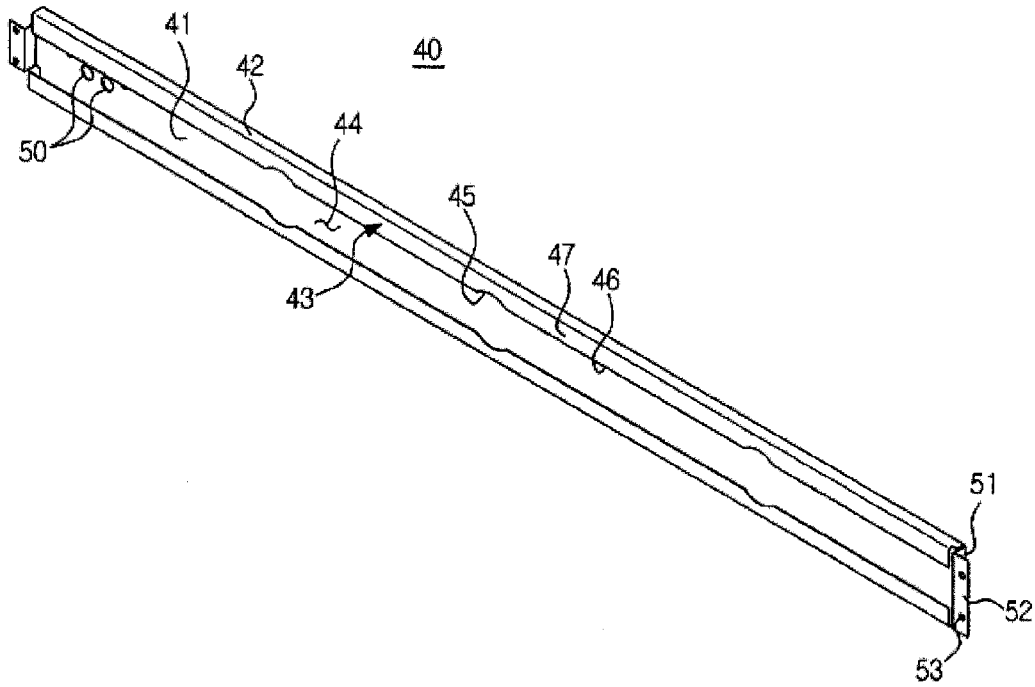
FIG. 3 is a rear perspective view of the mid-front plate shown in FIG. 2.

FIG. 3 is a rear perspective view of the mid-front plate shown in FIG. 2.

Referring to FIG. 3, the mid-front plate 40 is provided in the form of a flat tube by bending an elongated single metal plate to form an interior space 44 (see FIG. 5) while having one open surface.

Such a configuration of the mid-front plate 40 offers a greater strength than the conventional mid-front plate. Accordingly, even though the reinforcing plate is not installed in the inner case 23 to reinforce the front surface of the middle wall 30, the mid-front plate 40 and the front part of the inner 23 corresponding to the middle wall 40 is prevented from being deformed.

In addition, the mid-front plate 40 according to the embodiment of the present disclosure is formed by bending a single metal plate through a roll forming; so that the manufacturing process is simplified, and the manufacturing cost is reduced.

In detail, the mid-front plate 40 includes a front side part 41 forming the external appearance of the refrigerator 20, an extension part 42 bent from the end of the front side part 41 to the rear side of the refrigerator 20, and a bending part 43 bent from the end of the extension part 42 to be approximately parallel to the front side part 41.

The bending part 43 includes an insertion hole part 45, an movement hole part 46, and a locking part 47.

The insertion hole part 45 may be provided in a predetermined number, for example, at least one, such that at least one insertion hole part 45 is spaced apart from each other lengthwise along the mid-front plate 40. The insertion hole part 45 needs to have a width (h4 in FIG. 5) greater than the width (h3 in FIG. 5) of a pressing part of the coupling member, such that the coupling member 60 (see FIG. 5) is inserted into the interior space 44 (FIG. 5) through the insertion hole 45. The inserting of the coupling member 60 to the insertion hole part 45 will be described later in detail.

The movement hole part 46 extends from the insertion hole part 46 lengthwise along the mid-front plate 40. The movement hole part 45 needs to have a width (h2 in FIG. 5) greater than the width (h1 in FIG. 5) of a support part of the coupling member 60 to move the mid-front plate 40 by a small degree to fix the mid-front plate 40 after the mid-front plate 40 is moved to the middle wall 30 to insert the coupling member 60 (see FIG. 5) into the interior space 44 (see FIG. 5) of the mid-front plate 40. The fixing of the mid-front plate 40 to the middle wall 30 will be described later in detail.

Figure 5:
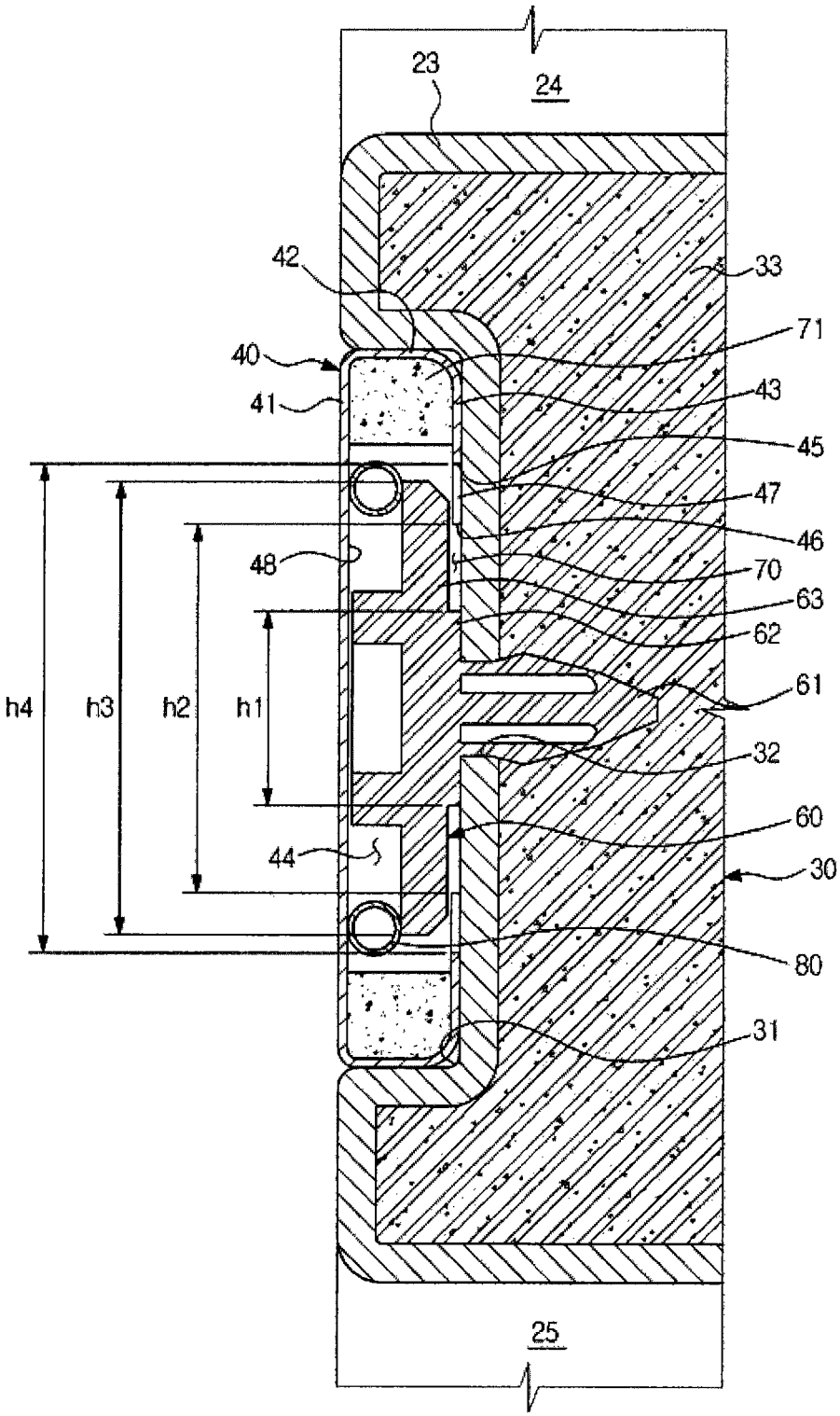
FIG. 5 is an assembled cross-sectional view of the coupling structure of FIG. 2.

The locking part 47 forms a plate around the movement hole part 46 which is substantially inserted between the coupling member 60 (see FIG. 5) and the middle wall 30 (see FIG. 5).

A lateral side part 51 is formed by bending both ends of the mid-front plate 40 lengthwise to a rear side of the mid-front plate 40. An edge part 52 is formed by bending the lateral side part 51 to be approximately parallel to the front surface of the middle wall 40. The edge part 52 is provided with a connecting hole 53 that enables a screw to be coupled thereto.

Meanwhile, the front side part 41 is provided at one side with a hinge coupling hole 50 to install the middle hinge 17 (see FIG. 1).

Figure 4:
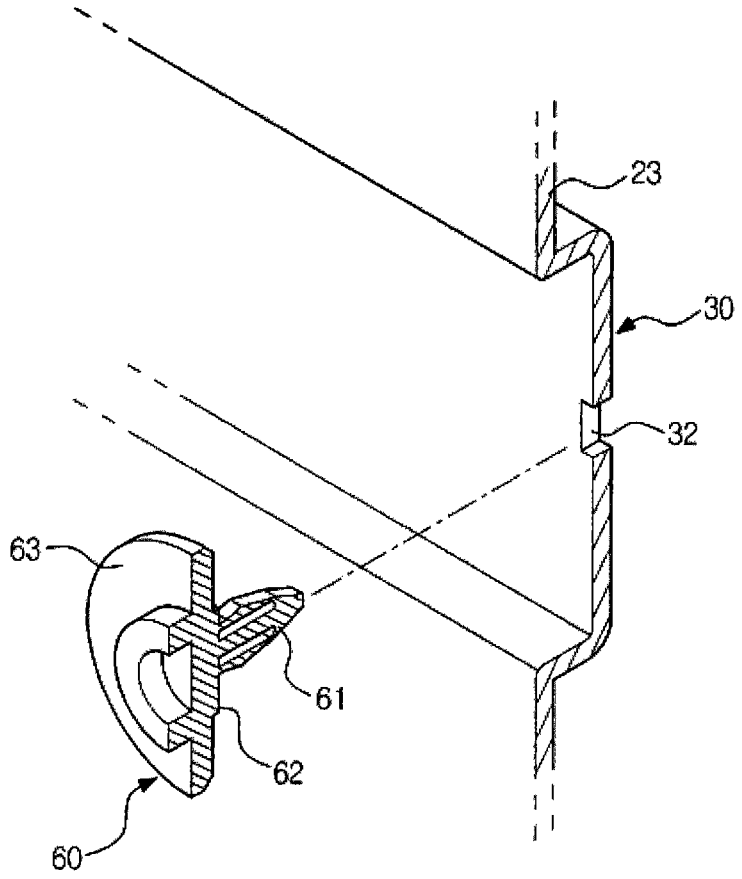
FIG. 4 is a view illustrating a coupling structure of a coupling member and the middle wall of FIG. 2.

FIG. 4 is a view illustrating a coupling structure of the coupling member and the middle wall of FIG. 2.

Referring to FIG. 4, the coupling member 60 includes an elastic clip 61, which is inserted into the fixing hole 32 of the middle wall 30, a support part 62 supported by the middle wall 30 while coming into close contact with the middle wall 30, and a pressing part 63 having a step difference with respect to the support part 62. The pressing part has a width h3 greater than the width h1 of the support part 62 to form a gap between the pressing part 63 and the middle wall 30. The configuration of the pressing part 63 and the support part 62 will be described later in detail.

The elastic clip 61 has a cross section of a diameter which is greater than that of the fixing hole 32. The elastic clip 61 is contracted by receiving external force to be press-fitted to the fixing hole 32, and then expanded through restoring force to be insertedly coupled to the fixing hole 32. In this manner, a gap is removed in the fixing hole 32 having the elastic clip 61 inserted thereto, thereby preventing foam liquid from leaking.

The support part 62 comes into a close contact with the middle wall 30 while being securely supported by the middle wall 30 when the coupling member 60 is insertedly coupled to the fixing hole 32.

The pressing part 63 having a step difference with respect to the support part 62 is spaced apart from the middle wall 30 when the coupling member 60 is insertedly coupled to the fixing hole 32, thereby forming a gap between the coupling member 60 and the middle wall 30; in detail, between the pressing part 63 of the coupling member 60 and the middle wall. Hereinafter, the gap will be referred to as a coupling gap 70 (see FIG. 5).

Each of the support part 62 and the pressing part has a circular cross section that provides the same cross section, regardless of the orientation that the coupling member 60 is coupled to the middle wall 30.

FIG. 5 is an assembled cross-sectional view of the coupling structure of FIG. 2.

Referring to FIG. 5, the configuration of the mid-front plate 40 and the coupling member 60, and the coupling structure of the mid-front plate 40 and the coupling member 60 will be described in detail. The same description made above will be omitted to avoid redundancy.

Referring to FIG. 5, the mid-front plate 40 is received in the receiving part 31 of the middle wall 30. The coupling member 60, the hot pipe 80, and a buffer member 71 are received in the interior space 44 of the mid-front plate 40.

The front side part 41 of the mid-front plate 40 is exposed to outside to form an external appearance. The extension part 42 and the bending part 43 come into contact with the middle wall 30.

As describe above, the coupling member 60 is fixed to the middle wall 30 as the elastic clip 61 is inserted into the fixing hole 32 of the middle wall 30, and the support part 62 is supported by the middle wall 30 while coming into a close contact with the middle wall 30.

The pressing part 63 of the coupling member 60 forms the coupling gap 70 between the coupling member 60 and the middle wall 30 while being spaced apart from the middle wall 30. The bending part 43 of the mid-front plate 40 is inserted into the coupling gap 70. In detail, the locking part 47 of the bending part 43 is inserted into the coupling gap 70.

That is, as the coupling member 60 presses the mid-front plate 40 to the middle wall 30; in detail, as the pressing part 63 of the coupling member 60 presses the locking part 47 of the bending part 43 of the mid-front plate 40 to the middle wall 30, the mid-front plate 40 is fixedly installed on the middle wall 30.

Meanwhile, the hot pipe 80 is also pressed against a rear surface 48 of the mid-front plate 40 by the pressing part 63 of the coupling member 60, such that the hot pipe 80 is fixed to the rear surface of the mid-front plate 40 while making contact with the rear surface of the mid-front plate 40. Accordingly, the hot pipe 80 comes into close contact with the front side part 41 of the hot pipe 80, thereby enhancing the heat exchange efficiency between the hot pipe 80 and the mid-front plate 40.

In order to reinforce the mid-front plate 40 and arrange the position of the hot pipe 80, the buffer member 71, for example, Styrofoam is inserted into the interior space 44 of the mid-front plate 40. The buffer member 71 may be inserted into an upper side and a lower side of the interior space 44.

Figure 6:
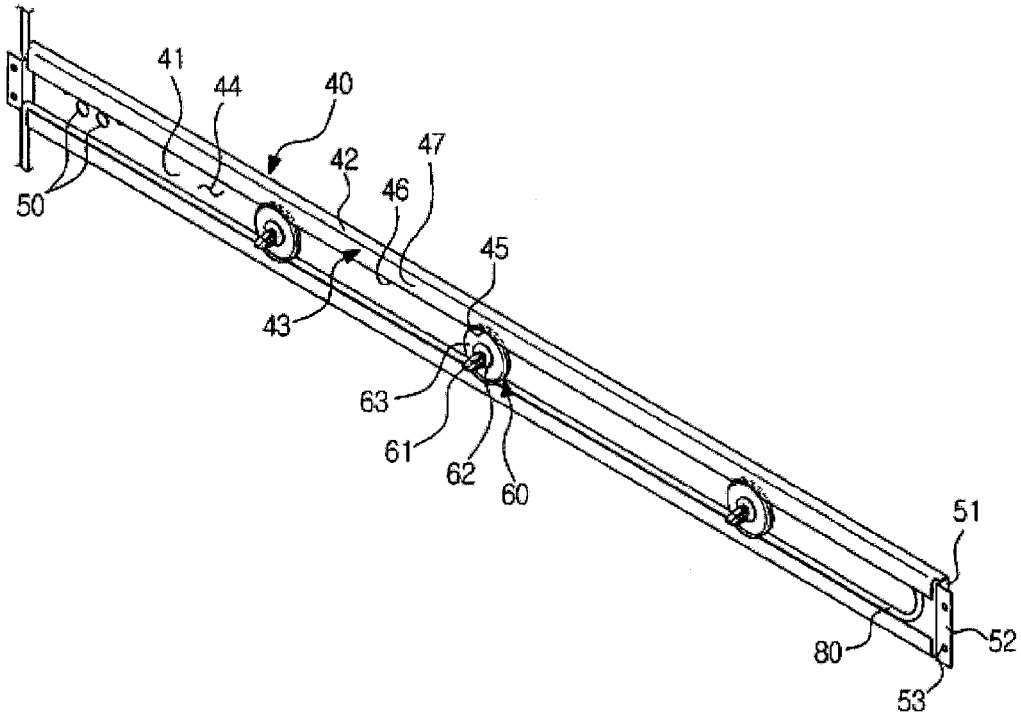
FIGS. 6 and 7 are views showing a process of fixing the mid-front plate of FIG. 2.
Figure 7:
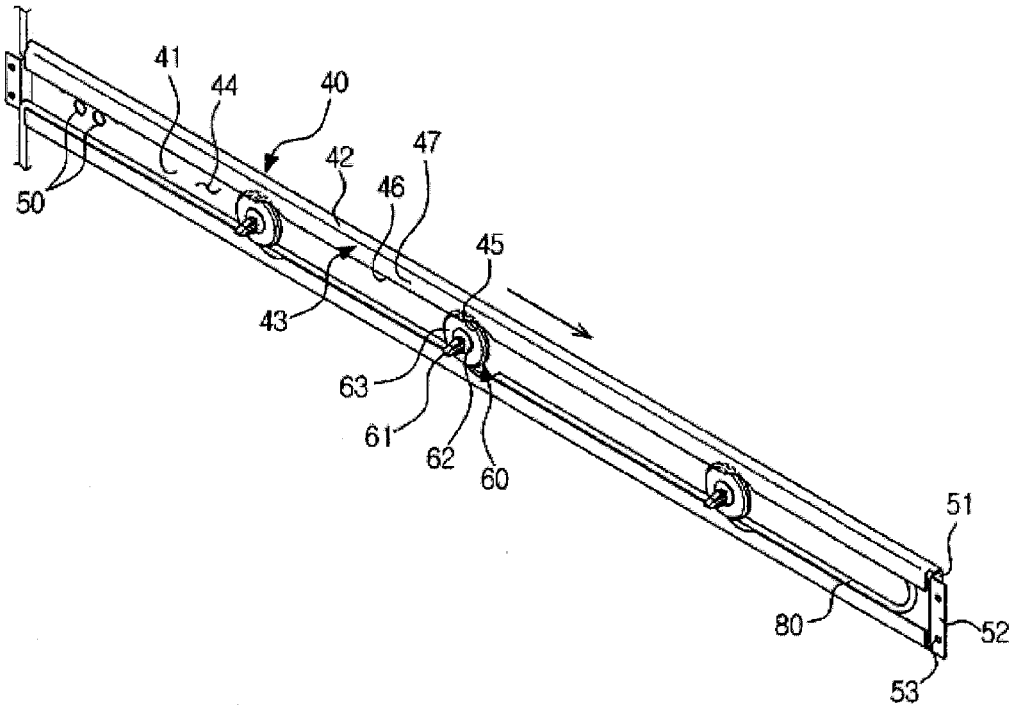

FIGS. 6 and 7 are views showing a process of fixing the mid-front plate of FIG. 2.

Hereinafter, a process of installing the mid-front plate according to the embodiment of the present disclosure will be described with reference to FIGS. 1 to 7.

In order to install the mid-front plate 40, the coupling member 60 is fixed to the middle wall 30. The coupling member 60 is fixed to the middle wall 30 by press-fitting the elastic clip 61 of the coupling member 60 to the fixing hole 32 of the middle wall 30.

Then, the mid-front plate 40 is disposed to the front surface of the receiving part 31 of the middle wall 30. The mid-front plate 40 is moved toward the middle wall 30, such that the coupling member 60 fixed to the middle wall 30 is inserted into the interior space 44 of the mid-front plate 40 by passing through the insertion hole part 45.

Then, referring to FIG. 7, the mid-front plate 40 is pushed to one side, such that the bending part 43 of the mid-front plate 40 is inserted between the coupling gap 70 formed between the coupling member 60 and the middle wall 30, so that the mid-front plate 40 is fixed.

In detail, as the mid-front plate 40 is pushed to one side, the locking part 47 of the bending part 43 of the mid-front plate 40 is inserted between the coupling gap 70 formed between the pressing part 63 of the coupling member 60 and the middle wall 30, so that the mid-front plate 40 is fixed.

Thereafter, a screw is sequentially coupled to the connecting hole 53 of the edge part 52 of the mid-front plate 40 and to a portion of the inner case 23 of the middle wall 30 corresponding to the connecting hole 53, and the outer case 22 is covered on the inner case 34, thereby finishing the installation of the mid-front plate 40.

Figure 8:
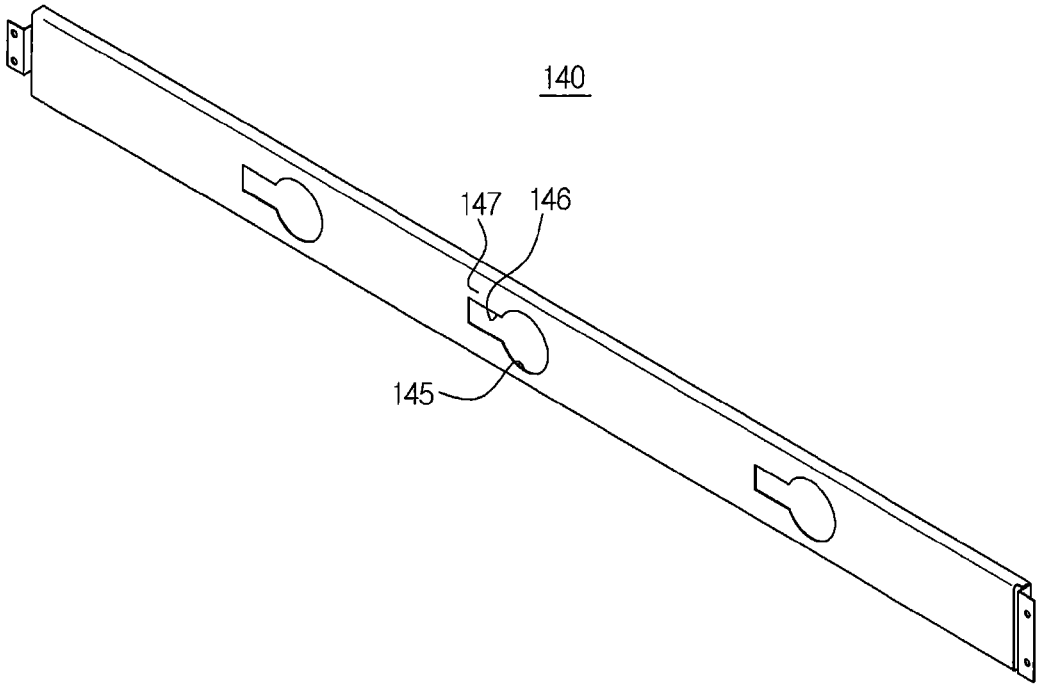
FIG. 8 is a rear perspective view illustrating a mid-front plate of a refrigerator according to an embodiment.

FIG. 8 is a rear perspective view illustrating a mid-front plate of a refrigerator according to an embodiment.

Referring to FIG. 8, a mid-front plate 140 according to another embodiment of the present disclosure includes an insertion hole part 145, a movement hole part 146, and a locking part 147.

The insertion hole 145 is provided in a predetermined number, for example, at least one, such that at least one insertion hole 145 is spaced apart from each other lengthwise along the mid-front plate 140.

The movement hole part 146 extends from the insertion hole part 145 lengthwise along the mid-front plate 140. Different from the previous embodiment, the movement hole part 146 extends by a predetermined length to be spaced away from an adjacent insertion hole part 145 without connecting the adjacent insertion parts 145 to each other.

Figure 9:
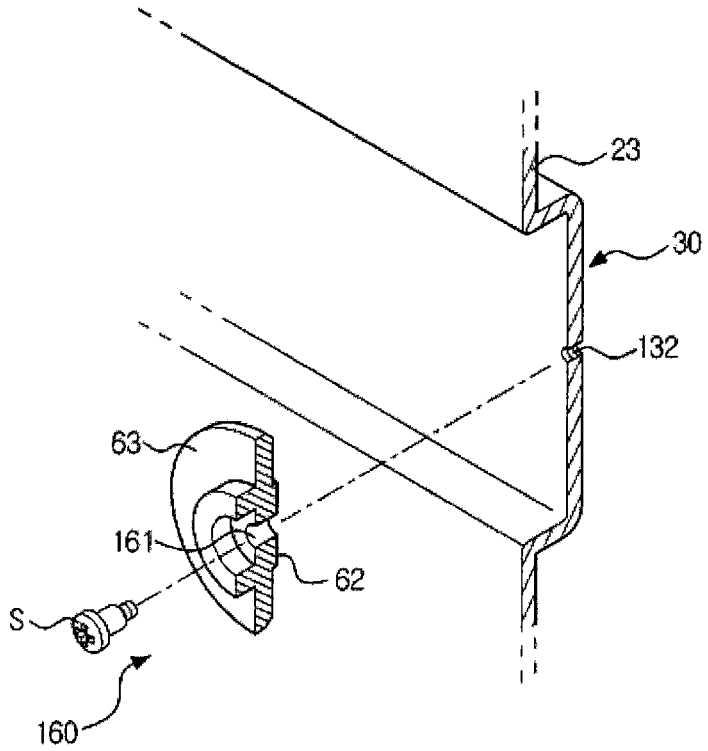
FIG. 9 is a view illustrating a coupling member of the refrigerator according to an embodiment.

FIG. 9 is a view illustrating a coupling member of the refrigerator according an embodiment.

Referring to FIG. 9, a coupling member according to another embodiment of the present disclosure includes a connecting hole 161 through which a screw is coupled to the inner case 23, the support part 62 supported by the middle wall 30 while coming into close contact with the middle wall 30, and the pressing part 63 having a step difference with respect to the support part 62. The middle wall 30 has a fixing hole 132 through which a screw (s) is coupled to the middle wall 30.

Although a few embodiments have been shown and described in the present disclosure, it would be appreciated by those skilled in the art that changes may be made in these embodiments without departing from the principles and spirit of the disclosure, the scope of which is defined in the claims and their equivalents.

What is claimed is:

1. A refrigerator comprising:

a body including an inner case forming a storage compartment and an outer case enabling thermal insulating material to be formed in a space between the inner case and the outer case;

a middle wall configured to divide the storage compartment into an upper storage compartment and a lower storage compartment;

a door installed on the body to open/close a front surface of the storage compartment that is openable;

a mid-front plate installed on a front surface of the middle wall; and a coupling member configured to fix the mid-front plate to the middle wall while being fixed to the front surface of the middle wall, wherein the mid-front plate includes an interior space to accommodate the coupling member and an insertion hole part allowing the coupling member to be inserted into the interior space therethrough, wherein the mid-front plate is fixed to the middle wall by moving the mid-front plate toward the middle wall such that the coupling member fixed to the middle wall is inserted into the interior space and then by pushing the mid-front plate to one side, and wherein the mid-front plate further comprises a movement hole part which extends from the insertion hole part lengthwise along the mid-front plate, and a locking part which is formed around the movement hole part and is inserted between the middle wall and the coupling member.

2. The refrigerator of claim 1, wherein a gasket is provided at a rear surface of the door to prevent cool air from leaking, and the gasket automatically comes into close contact with the front surface of the mid-front plate when the storage compartment is closed.

3. The refrigerator of claim 1, wherein the mid-front plate is formed by bending a single metal plate.

4. The refrigerator of claim 1, wherein the mid-front plate is provided in a form of a flat tub having one side open.

5. The refrigerator of claim 1, further comprising a hot pipe configured to prevent frost from being formed on the mid-front plate, wherein the hot pipe is accommodated in the interior space of the mid-front plate.

6. The refrigerator of claim 5, wherein the hot pipe comes into close contact with and is fixed to a rear surface of the mid-front plate while being pressed by the coupling member.

7. The refrigerator of claim 5, further comprising a buffer member inserted into the interior space to arrange the hot pipe and to reinforce the mid-front plate.

* * * * *